US005460105A

United States Patent [19]

Given, Jr.;

[11] Patent Number: 5,460,105

[45] Date of Patent: Oct. 24, 1995

[54] SLIDING TURNTABLE

[76] Inventor: Edward Y. Given, Jr., 710 Clearview Pl., South Bend, Ind. 46619

[21] Appl. No.: 207,220

[22] Filed: Mar. 8, 1994

[51] Int. Cl.[6] ..... A47B 11/00

[52] U.S. Cl. ..... 108/137; 108/140; 248/349.1; 248/430

[58] Field of Search ..... 108/137, 139, 108/140, 143, 94, 102, 103; 248/349, 430; 297/344.21, 344.26, 344.1

[56] References Cited

U.S. PATENT DOCUMENTS

| | | | |
|---|---|---|---|
| 332,360 | 12/1885 | Penney | 108/140 X |
| 1,737,956 | 12/1929 | Angert | 108/103 X |
| 1,742,904 | 1/1930 | Follmer | 108/103 X |
| 2,610,099 | 9/1952 | McNamara, Jr. | 108/140 |
| 3,055,721 | 9/1962 | Holt | 108/139 |
| 3,762,275 | 10/1973 | Imamura | 108/139 X |

FOREIGN PATENT DOCUMENTS

| | | | |
|---|---|---|---|
| 540946 | 9/1955 | Belgium | 108/140 |
| 1514135 | 2/1968 | France | 108/103 |
| 3234828 | 3/1984 | Germany | 108/143 |

*Primary Examiner*—Jose V. Chen
*Attorney, Agent, or Firm*—Brett A. Schenck

[57] ABSTRACT

A turntable having a bottom frame with a channel network formed on the bottom frame and a table top having a pair of guide roller attached thereon adjacent a side edge of the top. The rollers slideably engage the channels permitting the top to rotate one hundred and eighty degrees such that the top extends a minimal distance over the back edge of the bottom frame.

8 Claims, 7 Drawing Sheets

SLIDING TURNTABLE

BACKGROUND OF THE INVENTION

The present invention relates to a turntable for use on dollhouses, models, or other toys. While assembling or working on dollhouses or other models and toys, it is desirable to place the dollhouse on a turntable so that a user can work on the rear of the dollhouse without having to lift the dollhouse and turn it around. Many of these turntables are rectangular in shape to accomodate the similarly shaped dollhouses. Thus, when the top of the table is turned, the side portion of the top extends beyond the back bottom edge. This turntable poses a problem for freely rotating the dollhouse when as is usually the case the turntable is up against a back wall to prevent it from tipping over. A user must then move the turntable and dollhouse away from the back wall to provide proper clearance to permit the dollhouse to rotate 180 degrees. This procedure is inconvient, time consuming and often susceptible to the dollhouse falling off the turntable and damaging it.

Hence, it is an object of the present invention to provide a rectangular turntable for accomodating dollhouses so that a minimal part of the top of the table extends beyond the back table edge while rotating it.

SUMMARY OF THE INVENTION

The turntable comprises a bottom frame and a top. The bottom frame has U-shaped a channel network formed on the bottom frame. The top has a pair of guide rollers attached thereon and slideably engaging the channels to permit movement of the top from a front horizontal position to a rearward position at an arcuate distance of one hundred and eighty degrees such that the top extends a minimal distance over the back edge of the bottom frame during the movement.

BRIEF DESCRIPTION OF THE DRAWINGS

These and other features, aspects and advantages of the present invention will become better understood with regard to the following description, appended claims, and accompany drawings where:

DETAIL DESCRIPTION OF THE INVENTION

Figure 1:
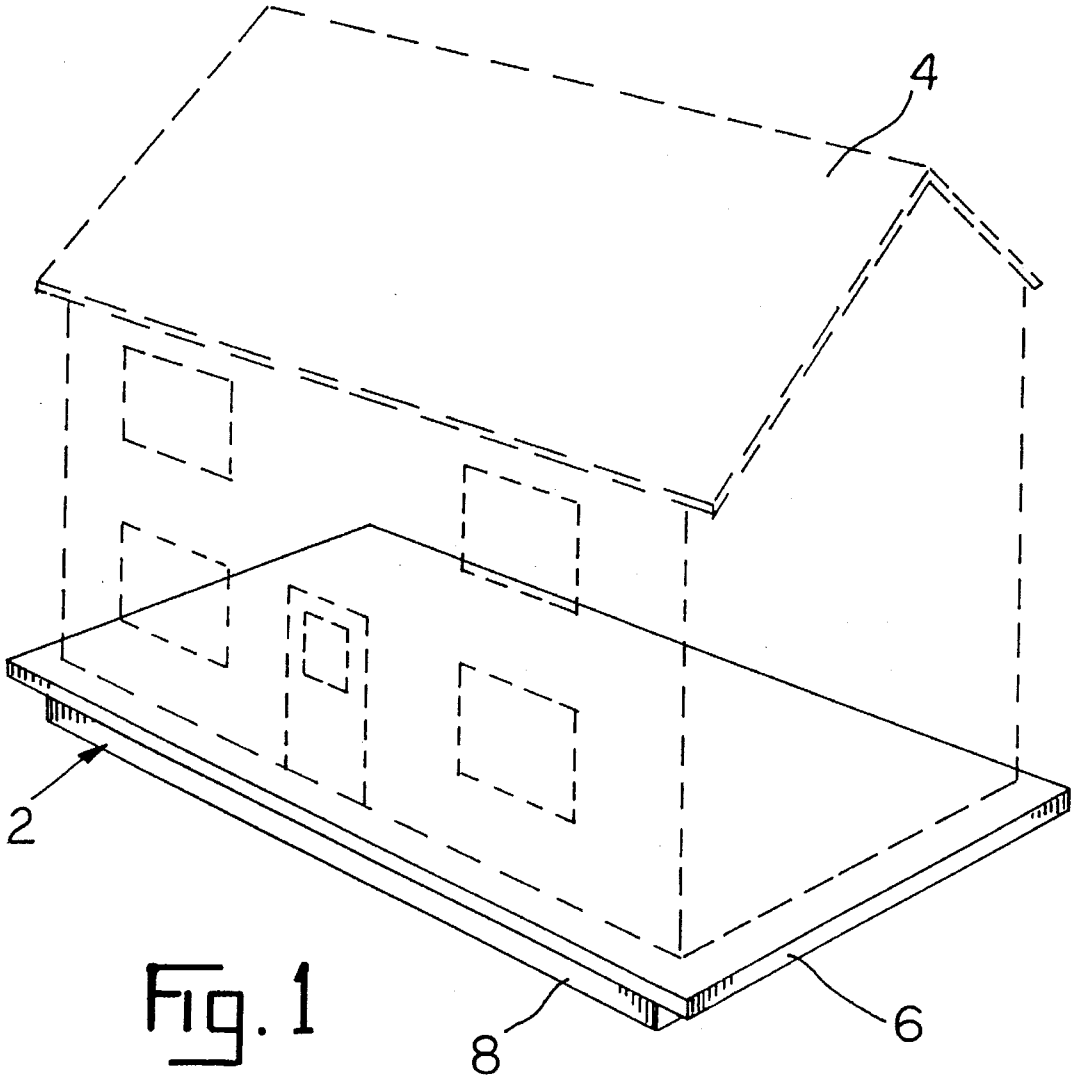
FIG. 1 shows a perspective view of the turntable with a dollhouse place upon it.
Figure 2:
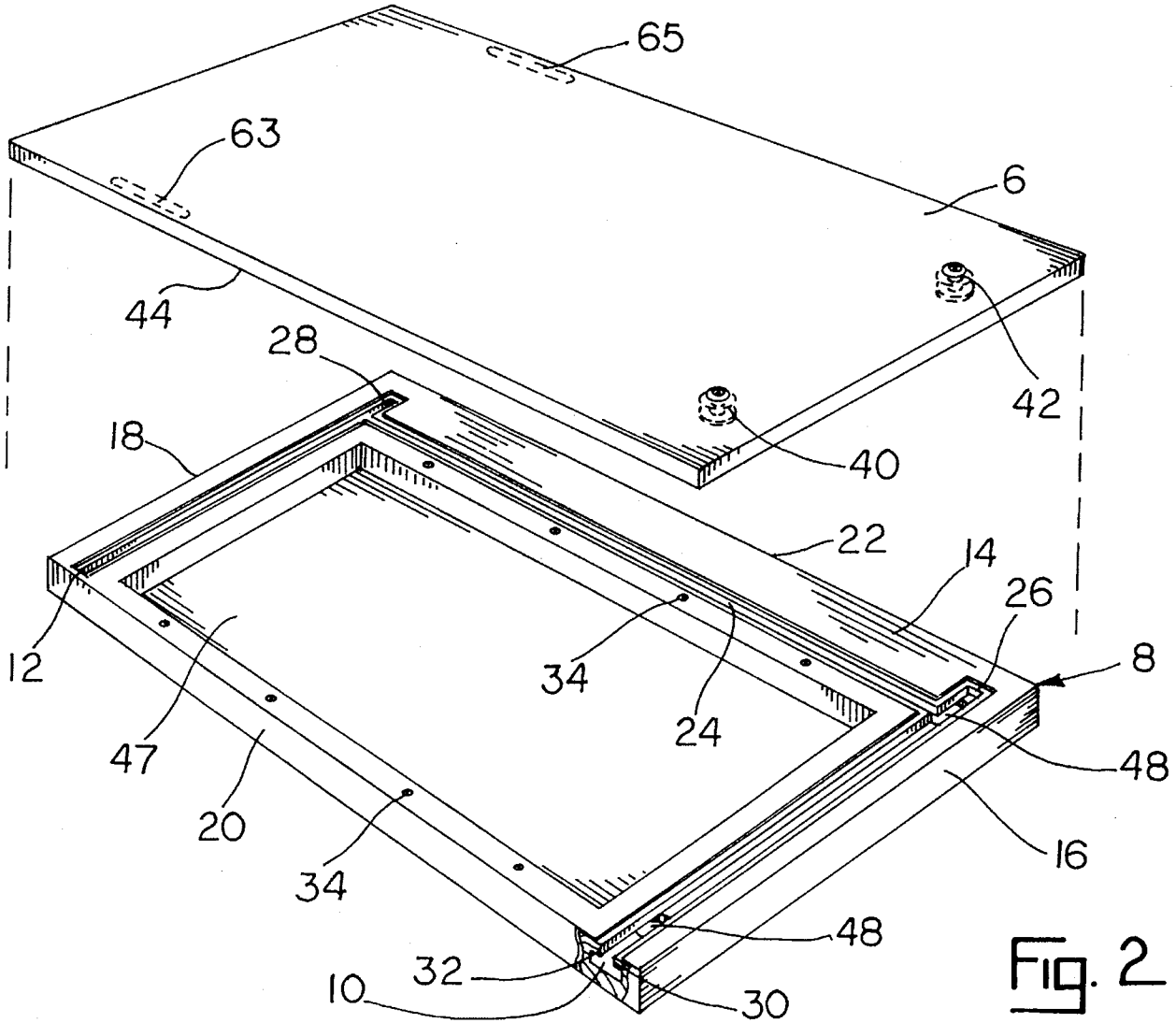
FIG. 2 shows an exploded perspective view of the turntable.

FIG. 1 shows the turntable 2 supporting a dollhouse 4, as shown by phantom lines. The turntable 2 includes a table top 6 and a bottom frame 8 both being rectangular in shaped and composed of wood. Referring to FIG. 2, the bottom frame 8 has a pair of right and left I-shaped channels 10 and 12, respectively, partially cut into the top surface 14 of the bottom frame 8 and each located about an inch from its corresponding right side edge 16 or left side edge 18 of the bottom frame 8. Each of the channels 10 and 12 extends from the front edge 20 of the bottom frame 8 to about an inch from its back edge 22 and is generally parallel to its corresponding left or right side edge of the bottom frame 8. A similarly cut rear I-shaped channel 24 extends from the right channel 10 to the left channel 12 and is located about an inch form the rear ends 26 and 28 of the channels 10 and 12. The rear channel 24 is generally perpendicular to the right and left channels and in communication with them so that the channels form a generally U-shaped network cut into the bottom frame 8. Each channel has rectangular horizontal projections 30 and 32 formed thereon opposing each other.

Figure 8:
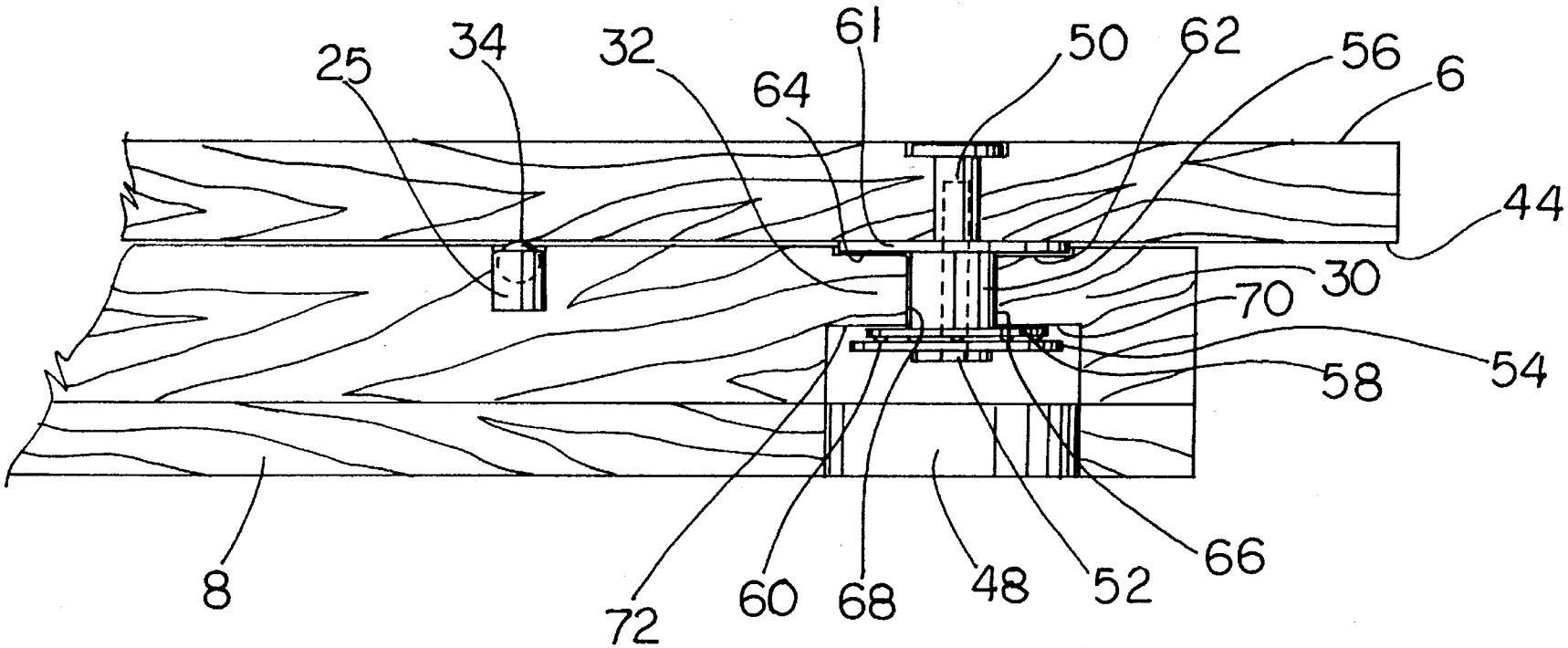
FIG. 8 shows a sectional front view of FIG. 3 taken along lines 8—8.

A row of four ball bearings 34 are recessed into the top surface 14 near the front edge 20 of the bottom frame 8. Another row of four ball bearings 34 are recessed into the top surface 14 adjacent the front of the rear channel 24. Each ball bearing is partially enclosed by a plastic sleeve 25 as seen in FIG. 8. These ball bearings reduce the sliding friction between the table top and bottom frame contacting surfaces to permit easier turning of the table top. It should be noted that other suitable means of reducing the sliding friction between the table top and bottom frame contacting surfaces can be used to permit easier turning of the table top such as covering each of the surfaces with a plastic or formica layer.

The bottom frame 8 further has a rectangular recess 47 located within the U-shaped channel network to reduce the area of contact between the surfaces for easier turing of the table top. A weighted plate member 38 (FIG. 3) is imbedded in the bottom frame near its rear or back edge 22 to equalize the weight so that the turntable does not tip over during its rotation. The bottom frame includes a pair of holes 48 under the right channel 10 for the insertion of guide rollers 40 and 42 when assembling the table top 6 to the bottom frame 8. After the turn table is assembled, the holes are filled by wooden plugs (not shown).

The table top 6 has front handle 63 and a rear handle 65 arcuately cut into its bottom surface 44. The table 6 includes a front guide roller 40 and a rear guide roller 42 mounted to the bottom surface 44 of the table top 6 such that the rollers are aligned parallel to the right side edge 16 and located approximately two inches from the right side edge 16 as shown in FIG. 2. As shown in FIG. 8, each guide roller includes a T-Nut 50 which is screwed into the the table top until the open end is flushed with the bottom surface 44 of the table top 6. A threaded connector bolt 52 is fixedly inserted through a lower washer 54 and cylindrical sleeve 56. The sleeve is preferably made of a low friction type material such as nylon or polyvinyl chloride. A washer bearing 58 with rollers 60 spaced circumferentially around it is inserted around the sleeve 56 and supported by the lower washer 54. The connector bolt 52 is then fixedly inserted through an upper washer 61 and is screwed securely into The T-Nut 50. The washers are made of low friction type material.

Figure 3:
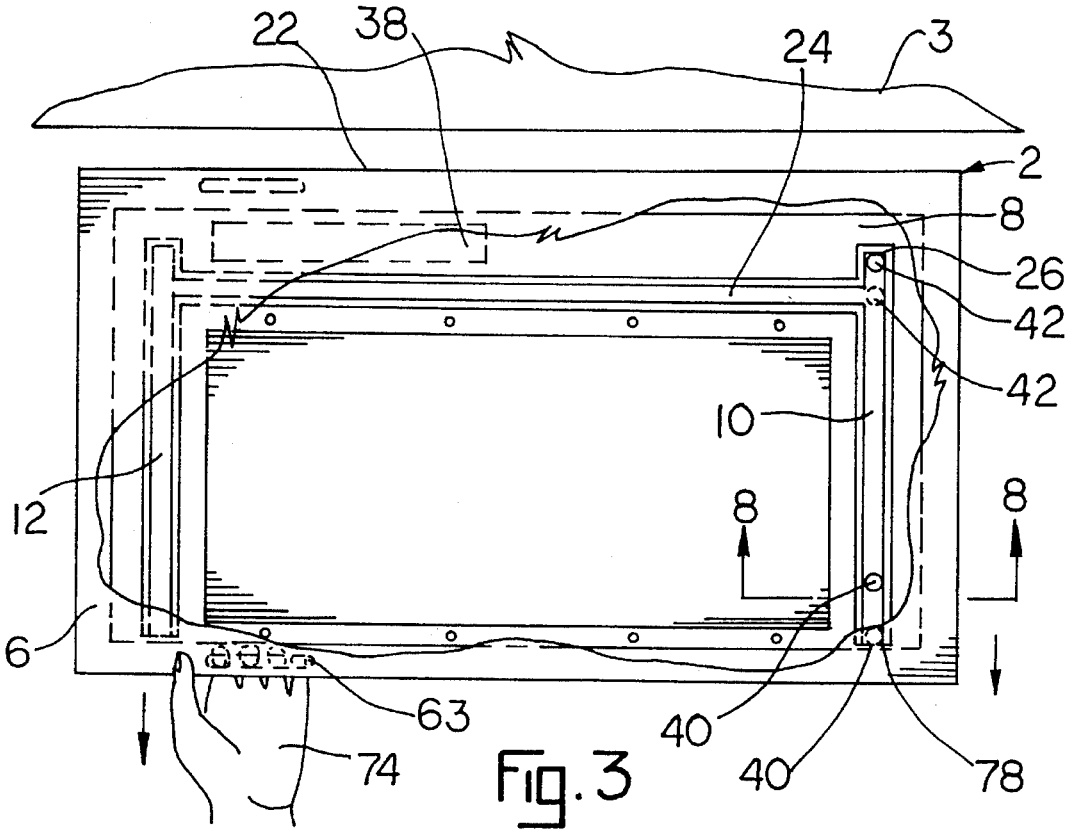
FIG. 3 shows a top plan view of the turntable in its frontal position with portions cut away to show the channels and positions of the rollers.

The guide rollers 40 and 42 are slideably situated in the channel network such that the upper washer 61 is positioned just above the top surfaces 62 and 64 of the projections 30 and 32 and the sleeve 56 is inserted through the opening between the sides 66 and 68 of the projections. The washer bearing contacts the bottom surface 70 and 72 of the projections and freely rotates when the table top is slid or rotated permittng easier movement of the top 6. In its frontal position as shown in FIG. 3, the guide rollers 40 and 42 are slideably situated in the right channel 10 with the rear guide roller 42 abutting the back end 26 of the right channel. Due to the guide rollers' positions, rotational movement of the top 6 is restricted so that a user can work on the dollhouse 2. The turntable 2 is also positioned against a back wall 3 and spaced a small distance from the wall 3 as seen in FIGS. 3 through 7.

Figure 4:
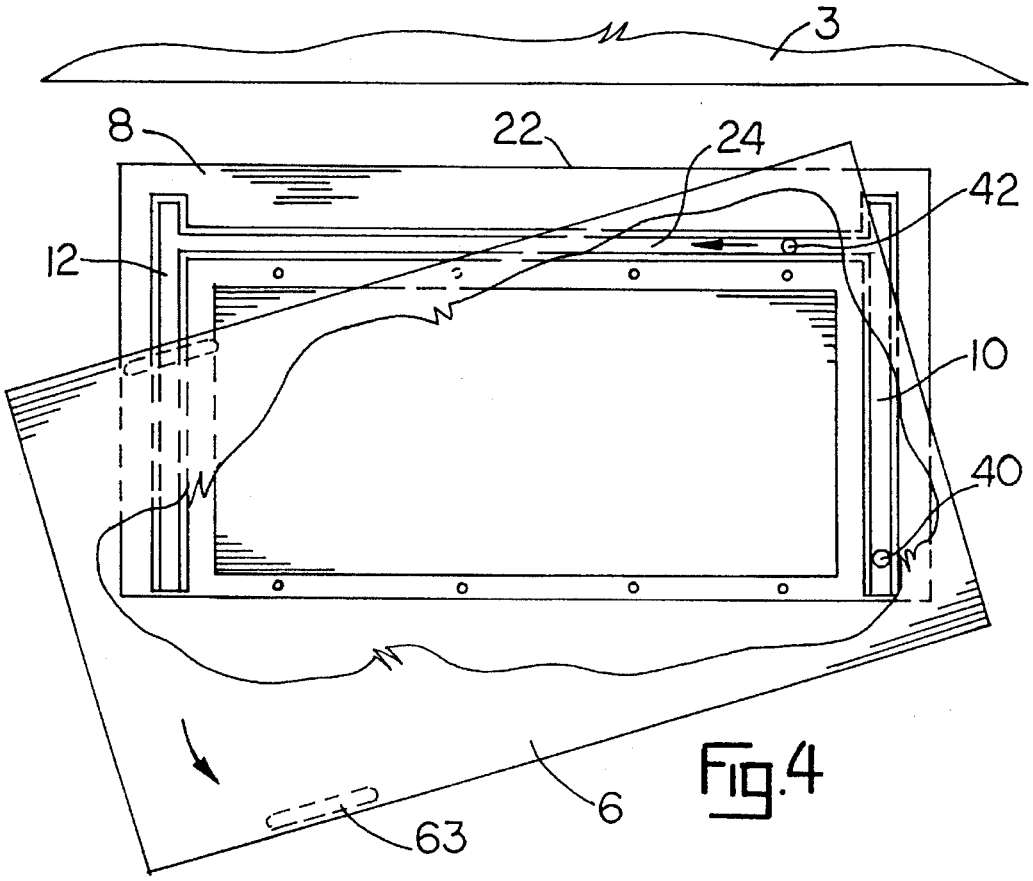
FIG. 4 shows a top plan view of the turntable showing the first rotation of the top with portions cut away to show the channels and positions of the rollers.
Figure 5:
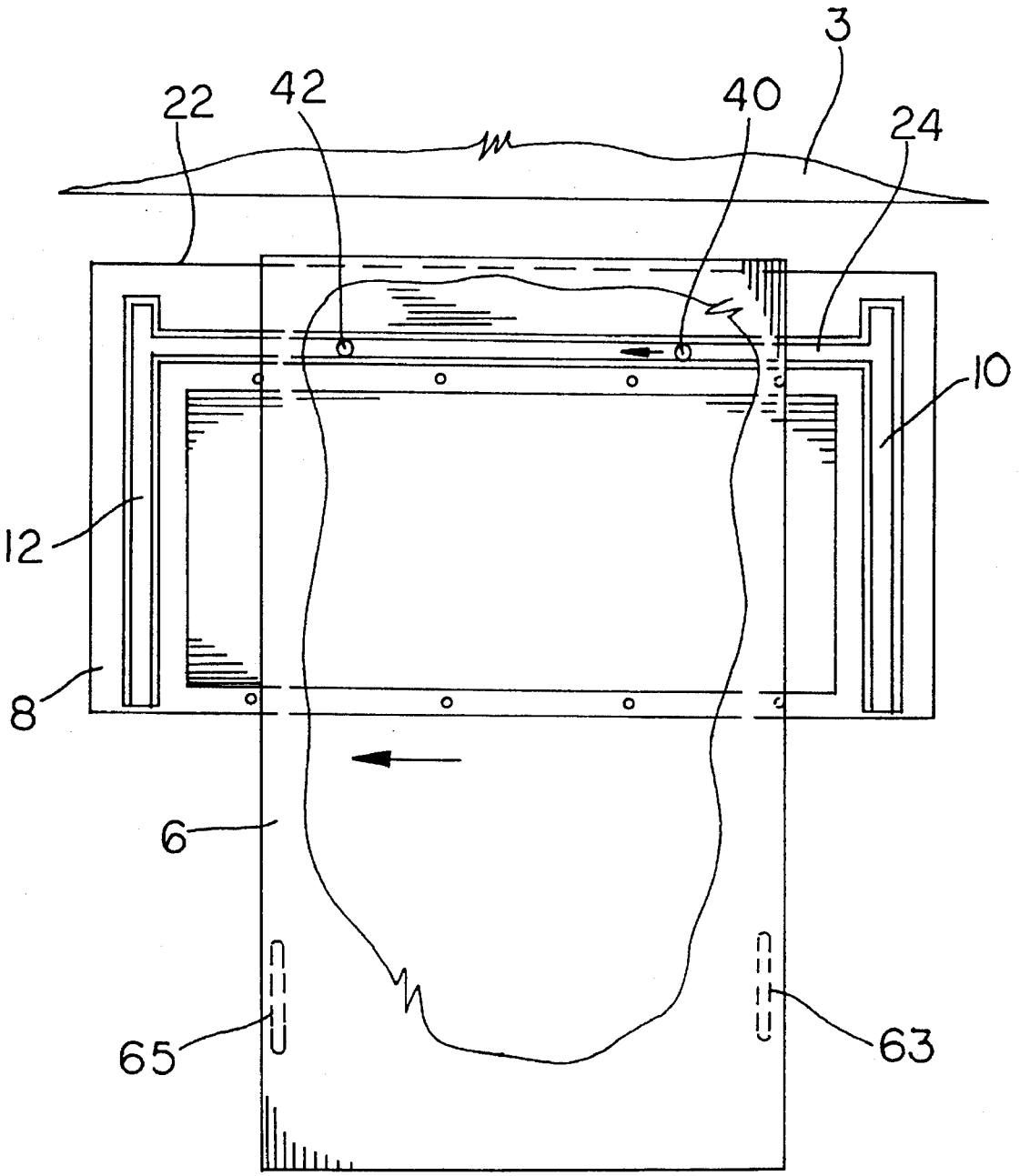
FIG. 5 shows a top plan view of the turntable when rotated ninety degrees and slid along the rear channel with portions cut away to show the channels and positions of the rollers.
Figure 6:
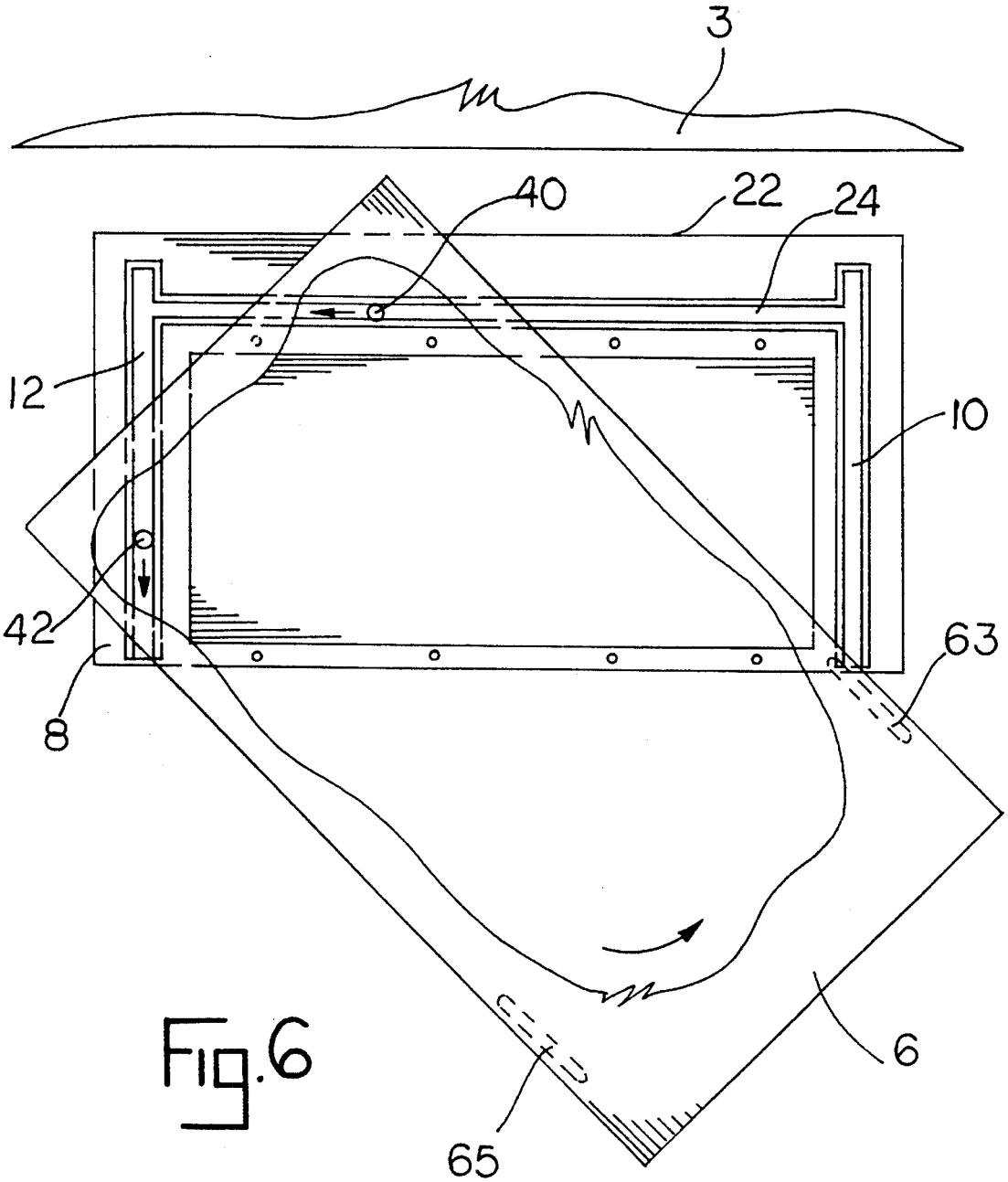
FIG. 6 shows a top plan view of the turntable showing the second rotation of the top with portions cut away to show the channels and positions of the rollers.
Figure 7:
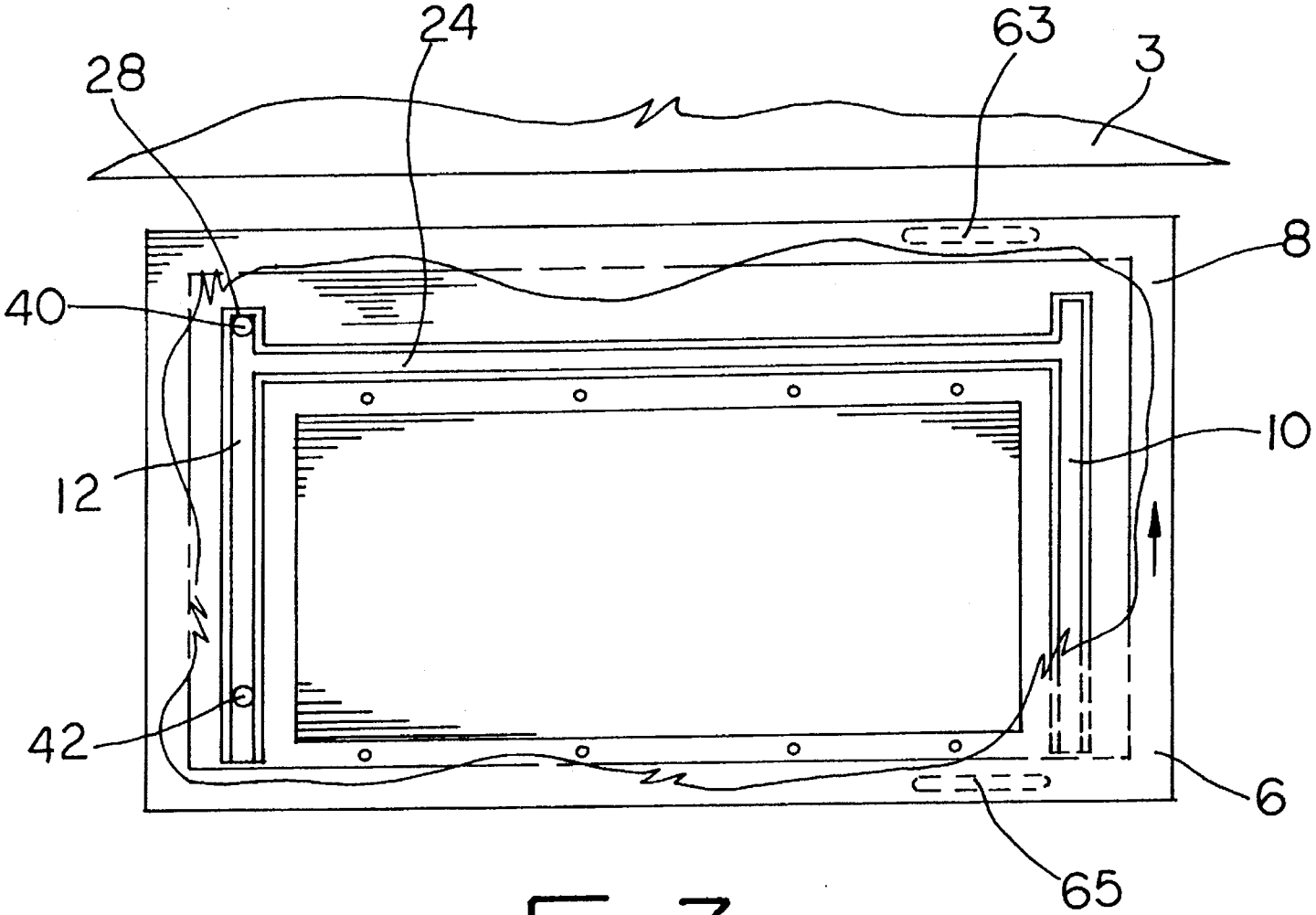
FIG. 7 shows a top plan view of the turntable in its rearward position with portions cut away to show the channels and positions of the rollers.

In operation, a user grasps the front handle 63 with his hand 74 and pulls the table top forward from its frontal stationary position until the front guide roller 40 engages the forward end 78 of the right channel 10 and the rear roller 42 is aligned with the rear channel 24 as indicated by the phantom lines showing only the roller positions. The table top is then rotated in a counterclockwise direction such that the rear guide roller 42 travels toward the left channel along the rear channel 24 and the front guide roller 40 travels rearwardly along the right channel as shown in FIG. 4. When the table top is rotated 90 degrees with respect to the longitudinal axis of the bottom frame 8, the front guide roller 40 is aligned with the rear channel 24 so that the table top 6 can be slid along the rear channel 24 towards the left channel 12 as shown in FIG. 5. When the rear guide roller 42 reaches the left channel 12, the table top is then rotated counterclockwise such that the rear guide roller 42 travels forwardly along the left channel 12 as shown in FIG. 6. When the table top 6 is rotated 90 degrees with respect to the longitudinal axis of the bottom frame, the rear guide roller 42 is aligned with the left channel 12 so that the table top can be slid back in a stationary rearward position with the front roller abutting the rear end 28 of the left channel 12 as seen in FIG. 7.

The table can be similarly moved in the reverse directon back to its frontal position. As can be seen by the figures, the table top 6 extends very little over the back edge 22 of the bottom frame 8 during the one hundred and eighty degree rotation and thus will not interfere with the back wall 3. It should be noted that the turntable can be used to work on structures other than dollhouses. Additional changes and modifications to the embodiment of the invention as described herein can also be made, as will be apparent to those skilled in the art, while still remaining within the spirit and scope of the disclosed invention as set forth in the appended claims.

What is claimed is:

1. A turntable comprising:

a bottom frame having front and back edges, a first channel being formed on said bottom frame, a second channel being formed on said bottom frame and extending generally perpendicular with respect to said first channel, a third channel being formed on said bottom frame and extending generally parallel with respect to said second channel, said channels being in communication with one another; and a top having a pair of guide rollers slideably engaging said channels for permitting movement of said top from a first horizontal position to a second horizontal position at an arcuate distance of one hundred and eighty degrees such that said top extends a minimal distance over the back edge of said bottom frame.

2. A turntable according to claim 1 wherein said channels are configured to form a U-shape network, said first channel being located adjacent said back edge.

3. A turntable according to claim 2 wherein said guide rollers include locking means for permitting said table top to move only in said horizontal direction.

4. A turntable according to claim 3 wherein each of said guide rollers includes a washer bearing having a plurality of roller bearings spaced circumferntially around said washer bearing permitting easier movement of said table top.

5. A turntable according to claim 1 wherein each of said channels has a pair of horizontal projections opposing each other, each of said horizontal projections having an upper and lower surface, each of said guide rollers having a part slideably situated between said horizontal projections, said part extending through an upper washer and a lower washer, said upper washer positioned upon said upper surface of said horizontal surface and a lower washer positioned upon said lower surface of said horizontal surface such that said table top moves only in the horizontal direction.

6. A turntable according to claim 5 wherein each of said guide rollers includes a washer bearing having a plurality of rollers spaced circumferentially around said washer bearing permitting easier movement of said table top.

7. A turntable according to claim 6 including a plurality of ball bearings positioned between said top and said bottom frame to permit easier movement of said top.

8. A turntable according to claim 6 wherein said part is a sleeve composed of a low friction type material.

* * * * *